US008505621B2

(12) United States Patent
Telfer et al.

(10) Patent No.: US 8,505,621 B2
(45) Date of Patent: Aug. 13, 2013

(54) WELL ASSEMBLY WITH RECESSES FACILITATING BRANCH WELLBORE CREATION

(75) Inventors: Stuart Alexander Telfer, Stonehaven (GB); Dan Parnell Saurer, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 392 days.

(21) Appl. No.: 12/750,215

(22) Filed: Mar. 30, 2010

(65) Prior Publication Data

US 2011/0240282 A1 Oct. 6, 2011

(51) Int. Cl.
*E21B 7/06* (2006.01)
*E21B 43/30* (2006.01)

(52) U.S. Cl.
USPC ..... 166/117.5; 166/50; 166/242.5; 175/61

(58) Field of Classification Search
USPC ..... 166/50, 177.5, 169, 242.5, 242.6, 166/376, 313, 74, 117.5; 138/92, 177, 178; 175/61, 62
See application file for complete search history.

(56) References Cited

U.S. PATENT DOCUMENTS

| | | | | |
|---|---|---|---|---|
| 2,173,035 | A * | 9/1939 | Armentrout et al. | 166/381 |
| 2,913,051 | A * | 11/1959 | Lister | 166/291 |
| 3,178,088 | A | 4/1965 | Herr | |
| 3,980,106 | A | 9/1976 | Wiggins | |
| 4,890,675 | A | 1/1990 | Dew | |
| 5,275,240 | A | 1/1994 | Peterson et al. | |
| 5,297,640 | A | 3/1994 | Jones | |
| 5,355,956 | A * | 10/1994 | Restarick | 166/296 |
| 5,456,317 | A * | 10/1995 | Hood et al. | 166/296 |
| 5,458,209 | A | 10/1995 | Hayes et al. | |
| 5,462,120 | A | 10/1995 | Gondouin | |
| 5,564,503 | A | 10/1996 | Longbottom et al. | |
| 5,579,829 | A | 12/1996 | Comeau et al. | |
| 5,615,740 | A | 4/1997 | Comeau et al. | |
| 5,725,060 | A * | 3/1998 | Blount et al. | 175/61 |

(Continued)

FOREIGN PATENT DOCUMENTS

| | | |
|---|---|---|
| WO | 9809053 | 3/1998 |
| WO | 2009142914 | 11/2009 |

OTHER PUBLICATIONS

Seals, Parker T. et al., "A Seal Usable in Standard O-Ring Grooves With Built-in Resistance to Spiraling and Extrusion", Parker Seal Group, Irvine, 1992, 5 pages.

(Continued)

*Primary Examiner* — David Bagnell
*Assistant Examiner* — Wei Wang
(74) *Attorney, Agent, or Firm* — Kilpatrick Townsend & Stockton LLP

(57) ABSTRACT

Assemblies can be disposed in a subterranean bore. An assembly can include a recessed portion in an inner wall and another recessed portion in an outer wall. The recessed portions can each be configured to have a cross-sectional thickness that is less than at least another part of the assembly. The assembly can provide a seal between an inner region defined by the assembly and an environment exterior to the assembly prior to a window being created in the recessed portion in the outer wall through which a branch wellbore can be formed. The recessed portion in the inner wall can guide a cutting tool toward the recessed portion in the outer wall.

20 Claims, 5 Drawing Sheets

(56) References Cited

U.S. PATENT DOCUMENTS

| | | | | |
|---|---|---|---|---|
| 5,749,605 | A | 5/1998 | Hampton et al. | |
| 5,887,655 | A | 3/1999 | Haugen et al. | |
| 5,944,108 | A | 8/1999 | Baugh et al. | |
| 5,957,225 | A * | 9/1999 | Sinor | 175/57 |
| 6,012,526 | A | 1/2000 | Jennings et al. | |
| 6,012,527 | A | 1/2000 | Nitis et al. | |
| 6,024,169 | A * | 2/2000 | Haugen | 166/298 |
| 6,041,855 | A | 3/2000 | Nistor | |
| 6,065,209 | A | 5/2000 | Gondouin | |
| 6,070,665 | A | 6/2000 | Singleton et al. | |
| 6,073,697 | A | 6/2000 | Parlin et al. | |
| 6,202,752 | B1 | 3/2001 | Kuck et al. | |
| 6,206,111 | B1 | 3/2001 | Nistor | |
| 6,209,644 | B1 | 4/2001 | Brunet | |
| 6,213,228 | B1 | 4/2001 | Saxman | |
| 6,263,972 | B1 * | 7/2001 | Richard et al. | 166/381 |
| 6,279,659 | B1 * | 8/2001 | Brunet | 166/313 |
| 6,374,924 | B1 * | 4/2002 | Hanton et al. | 175/6 |
| 6,386,287 | B2 | 5/2002 | George | |
| 6,419,021 | B1 * | 7/2002 | George et al. | 166/313 |
| 6,419,026 | B1 * | 7/2002 | MacKenzie et al. | 166/381 |
| RE37,867 | E * | 10/2002 | Gondouin | 166/380 |
| 6,533,040 | B2 | 3/2003 | Gondouin | |
| 6,536,525 | B1 | 3/2003 | Haugen et al. | |
| 6,547,006 | B1 | 4/2003 | Kuck et al. | |
| 6,550,550 | B2 * | 4/2003 | Hanton et al. | 175/61 |
| 6,561,279 | B2 * | 5/2003 | MacKenzie et al. | 166/381 |
| 6,561,732 | B1 * | 5/2003 | Bloomfield et al. | 405/43 |
| 6,766,859 | B2 | 7/2004 | Haugen et al. | |
| 6,811,189 | B1 | 11/2004 | DeLange et al. | |
| 6,848,504 | B2 | 2/2005 | Brunet et al. | |
| 6,868,909 | B2 | 3/2005 | Murray | |
| 6,913,082 | B2 * | 7/2005 | McGlothen et al. | 166/313 |
| 6,945,279 | B2 | 9/2005 | Baba et al. | |
| 6,971,449 | B1 * | 12/2005 | Robertson | 166/297 |
| 7,025,144 | B2 | 4/2006 | Haugen et al. | |
| 7,104,324 | B2 | 9/2006 | Wetzel et al. | |
| 7,213,652 | B2 | 5/2007 | Hepburn et al. | |
| 7,225,875 | B2 | 6/2007 | Steele et al. | |
| 7,487,840 | B2 | 2/2009 | Gammage et al. | |
| 7,588,056 | B2 | 9/2009 | Lord et al. | |
| 7,703,524 | B2 | 4/2010 | Parlin | |
| 7,726,401 | B2 | 6/2010 | Parlin et al. | |
| 8,020,620 | B2 * | 9/2011 | Daniels et al. | 166/297 |
| 2002/0170713 | A1 * | 11/2002 | Haugen et al. | 166/298 |
| 2003/0075334 | A1 * | 4/2003 | Haugen et al. | 166/313 |
| 2003/0141063 | A1 | 7/2003 | Haugen et al. | |
| 2003/0155124 | A1 * | 8/2003 | Nguyen et al. | 166/287 |
| 2004/0011529 | A1 * | 1/2004 | McGarian et al. | 166/313 |
| 2004/0159435 | A1 * | 8/2004 | Plucheck et al. | 166/313 |
| 2004/0168807 | A1 * | 9/2004 | McGlothen et al. | 166/313 |
| 2004/0262006 | A1 * | 12/2004 | Dewey et al. | 166/313 |
| 2005/0145392 | A1 | 7/2005 | Haugen et al. | |
| 2005/0241831 | A1 * | 11/2005 | Steele et al. | 166/313 |
| 2006/0201570 | A1 | 9/2006 | Lord et al. | |
| 2006/0289156 | A1 | 12/2006 | Murray | |
| 2007/0039741 | A1 * | 2/2007 | Hailey, Jr. | 166/376 |
| 2009/0045974 | A1 | 2/2009 | Patel | |
| 2009/0255687 | A1 | 10/2009 | Mccullough et al. | |
| 2009/0272537 | A1 | 11/2009 | Alikin et al. | |
| 2009/0288829 | A1 * | 11/2009 | Parlin | 166/285 |
| 2010/0051269 | A1 | 3/2010 | Smithson et al. | |
| 2010/0071905 | A1 * | 3/2010 | Renshaw et al. | 166/313 |

OTHER PUBLICATIONS

Thiele, Jr., et al., "Comparative Machinability of Brasses, Steels and Aluminum Allows: CDA's Universal Machinability Index," SAE Technical Paper 900365, Feb. 1990 (ten pages).

Hilbert, et al., "Evaluating Pressure Integrity of Polymer Ring Seals for Threaded Connections in HP/HT Wells and Expandable Casing," 2004, IADC/SPE Drilling Conference (twelve pages).

U.S. Appl. No. 12/700,448, filed Feb. 4, 2010 (thirty-seven pages).

U.S. Appl. No. 12/726,717, filed Mar. 18, 2010 (twenty-nine pages).

U.S. Appl. No. 12/751,343, filed Mar. 31, 2010 (thirty-two pages).

U.S. Appl. No. 12/789,822, filed May 28, 2010 (fifty-three pages).

* cited by examiner

WELL ASSEMBLY WITH RECESSES FACILITATING BRANCH WELLBORE CREATION

TECHNICAL FIELD OF THE INVENTION

The present invention relates generally to an assembly for subterranean fluid production and, more particularly (although not necessarily exclusively), to an assembly that includes a recess in an outer wall and a recess in an inner wall, where the recesses can assist in facilitating branch wellbore creation.

BACKGROUND

Hydrocarbons can be produced through a wellbore traversing a subterranean formation. The wellbore may be relatively complex. For example, the wellbore can include branch wellbores, such as multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first direction and a secondary wellbore diverted from the main wellbore and in a second general direction. A multilateral wellbore can include a window to allow lateral wellbores to be formed. A sidetrack wellbore can include a window to allow the wellbore to be diverted to the second general direction.

A window can be formed by positioning a casing joint and a whipstock in a casing string at a desired location in the main wellbore. The whipstock can deflect one or more mills laterally (or in one or more various orientations) relative to the casing string. The deflected mills penetrate part of the casing joint to form the window in the casing string through which drill bits can form the lateral wellbore or the secondary wellbore.

Casing joints are often made from high-strength material. The high-strength material may also be non-corrosive to withstand corrosive elements, such as hydrogen sulfide and carbon dioxide, which may be present in the subterranean environment. Milling a portion of the high-strength material can be difficult and can create a large amount of debris, such as small pieces of the casing joint, that can affect detrimentally well completion and hydrocarbon production. The debris can prevent the whipstock from being retrieved easily after milling is completed, plug flow control devices, damage seals, obstruct seal bores, and interfere with positioning components in the main bore below the casing joint.

Casing joints with pre-milled windows can be used to reduce or eliminate debris. The pre-milled windows can include an outer liner (or sleeve) to prevent particulate materials from entering the inner diameter of the casing string. The outer liner, which can be made from aluminum or fiberglass for example, can be milled easily and milling the outer liner can result in less debris as compared to drilling a window through a casing joint made from high-strength material. O-rings can be provided at each end of the outer sleeve to provide a seal between the outer sleeve and the casing joint.

The outer liners and the O-rings increase the outer diameter of the casing string. In some applications, the outer diameter may be increased by one or more inches. An increase in the outer diameter can be unacceptable in some situations.

Therefore, an assembly through which a window can be formed is desirable that can provide sufficient support for a casing string and avoid requiring an increase in the outer diameter of the casing string. An assembly that can avoid introducing an unacceptable amount of debris after the window is formed through milling is also desirable.

SUMMARY

Certain embodiments of the present invention are directed to an assembly that can include a recessed portion in an inner wall and another recessed portion in an outer wall. The recessed portions can each be configured to have a cross-sectional thickness that is less than at least another part of the assembly. The assembly can provide a seal between an inner region defined by the assembly and an environment exterior to the assembly prior to a window being created in the recessed portion in the outer wall through which a branch wellbore can be formed. The recessed portion in the inner wall can guide a cutting tool toward the recessed portion in the outer wall.

In one aspect, a casing string that can be disposed in a bore is provided. The casing string includes a first portion in an inner wall and a second portion in an outer wall. The first portion has a smaller cross-sectional thickness than at least one other portion of the casing string. The second portion has a smaller cross-sectional thickness than at least one other portion of the casing string. The casing string can provide a pressure seal between an inner region defined by the casing string and an environment exterior to the casing string prior to at least part of the second portion being drilled or milled. The second portion can provide a channel for a cutting tool to traverse toward a formation adjacent to the assembly.

In at least one embodiment, the first portion is recessed and the second portion is recessed.

In at least one embodiment, the first portion can guide the cutting tool toward the second portion.

In at least one embodiment, the first portion includes a circumferential portion of the inner wall.

In at least one embodiment, the second portion includes at least one opening that has a plug positioned in it.

In at least one embodiment, the plug is made from aluminum.

In at least one embodiment, the second portion includes a tapered surface shape.

In at least one embodiment, the second portion does not overlap the first portion.

In at least one embodiment, the second portion includes at least one of a notch, a groove, or a recess.

In at least one embodiment, the first portion can provide a channel for a drilling tool or for a milling tool to traverse toward the second portion.

In at least one embodiment, the second portion can provide a channel for a drilling tool or for a milling tool to traverse toward a formation adjacent to the casing string.

In another aspect, a casing string that can be disposed in a bore is provided. The casing string includes three sections. A first section has first cross-sectional thickness and has a recessed portion in an inner wall of the casing string. The inner wall defines an inner region. A second section has a second cross-sectional thickness and has a second recessed portion that is in an outer wall of the casing string. A third section has a third cross-sectional thickness that is greater than the first cross-sectional thickness and the second cross-sectional thickness. The casing string can provide a pressure seal between the inner region and an environment exterior to the casing string prior to at least part of the second recessed portion being drilled or milled.

In at least one embodiment, the first cross-sectional thickness is substantially the same thickness as the second cross-sectional thickness.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
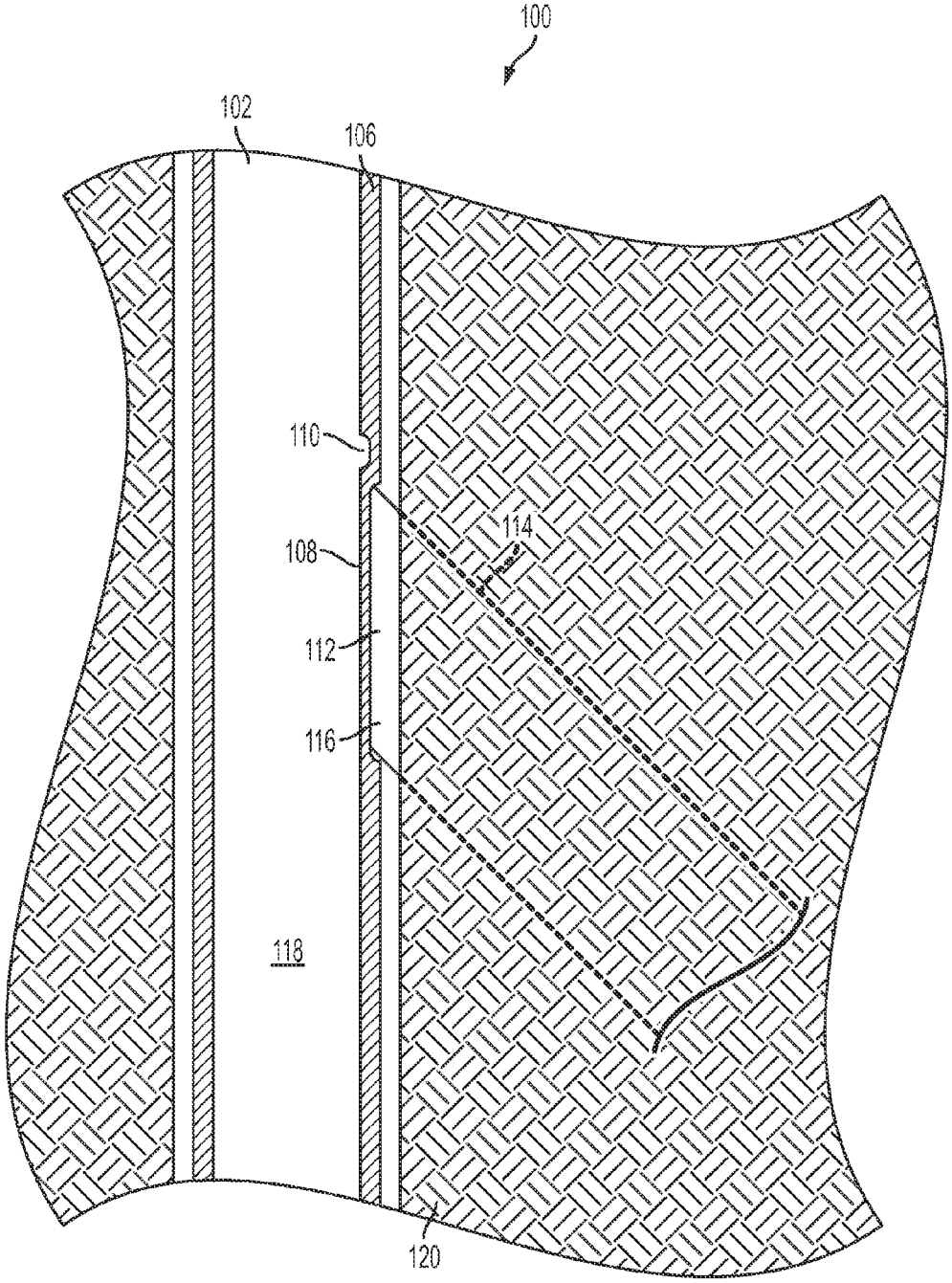
FIG. 1 is a schematic cross-sectional illustration of a well system having an assembly through which window can be formed to create a branch wellbore according to one embodiment of the present invention.

Certain aspects and embodiments of the present invention relate to assemblies capable of being disposed in a bore, such as a wellbore, of a subterranean formation and through which a window can be formed. An assembly according to certain embodiments of the present invention can provide support for a casing string in a high pressure and high temperature environment of a subterranean well, while avoiding an increase in the outer diameter of the casing string and may avoid introducing a large amount of debris after the window is formed through milling. An example of a high pressure and high temperature subterranean wellbore environment is one with a pressure greater than 2500 PSI and a temperature greater than 250° F.

In some embodiments, the assembly includes a recessed portion in an inner wall and a second recessed portion in an outer wall. The recessed portion and the second recessed portion can each be configured to have a cross-sectional thickness that is less than at least another part of the assembly. The assembly can be capable of providing a seal between an inner region defined by the assembly and an environment exterior to the assembly prior to part of the assembly being drilled or milled. For example, the assembly can be located in a bore and be capable of withstanding a high pressure and a high temperature subterranean environment by providing the pressure seal. A window can be created in the second recessed portion, through which a branch wellbore can be formed. In some embodiments, the recessed portion on the inner wall can be configured to guide a drilling tool or a milling tool toward the second recessed portion on the outer wall. For example, the recessed portion on the inner wall can provide a channel for drilling tool or for a milling tool to traverse toward the second recessed portion.

An assembly according to some embodiments can maintain structural integrity prior to a window being created for forming a branch wellbore. For example, the assembly can maintain integrity when exposed to forces such as burst and collapse pressure, tension, compression, and torque. In some embodiments, the portions of the assembly having the recesses have the same metallurgy as the other portions of the assembly. In other embodiments, it has a different metallurgy than other portions of the assembly. The assembly can reduce the volume of cuttings that is generated when forming the window. The assembly can also include a recess in an outer wall that is configured in shape to allow a selected window profile to be created. The assembly can ease downhole milling, reduce material to be removed, and ensure desired window geometry is achieved. For example, sides of a recess can guide the milling or drilling tool to create a straight window that maximizes effective window length through which a smoother branch wellbore hole can be created.

Assemblies according to some embodiments of the present invention can allow windows to be formed without requiring sleeves exterior to the assemblies for support, isolation, or otherwise. The outer diameter of the assemblies can thus be minimized, while maintaining pressure seals between inner regions and environments exterior to the assemblies. One or more recesses can allow smoother window edges to be created, reducing the chance of edges damaging components (e.g. packer elements and screens) run through the window. An assembly can allow the shape and size of each of the recess in an inner wall and a recess in an outer wall to be customized to allow easier downhole milling, downhole milling predisposition to a desired geometry, and optimizing pre-milled geometry.

In one embodiment, an assembly is a component of a casing string that is pre-milled to form a recess in an inner diameter of the casing string and to form another recess in an outer diameter of the casing string. The outer diameter recess and the inner diameter recess can be configured with respect to each other such that the inner diameter recess can provide for easier starting of milling or drilling downhole and the outer diameter recess can allow the milling or drilling tool to be guided as it exits the casing string.

The recess in the outer diameter can be formed by machining the outer wall of the casing string to remove a certain amount of casing string material such that the portion of the casing string with the outer diameter recess has a cross-sectional thickness that is less than other portions of the casing string. The portion of the casing string with the outer diameter recess can be configured to retain sufficient burst and collapse pressure resistance, and retain sufficient torque, tensile, and compression ratings. The surface width of the portion of the casing string with the outer diameter recess can be configured to allow a milling or drilling tool to pass and the edges of the outer diameter recess can help allow a window with a desired geometry to be created and to help reduce or eliminate spiraling.

Outer diameter recesses and inner diameter recesses can have various configurations. In some embodiments, an outer diameter recess is configured in shape to match desired window geometry. The portion of the assembly that is the outer diameter recess can include additional components to assist with milling, drilling, integrity support, or otherwise. For example, the portion can include one or more ribs or other support structures that are capable of providing burst, collapse, torque, torsion, and/or compression support to the portion. In some embodiments, the portion includes openings and each opening has a plug in it. The plugs may be made from a material that is easier to drill and/or mill, but that can cooperate with the casing string to provide a pressure seal between an inner region and an environment exterior to the casing string, before the window is created.

An assembly according to certain embodiments can retain its general shape and integrity during positioning of the assembly in a wellbore and for at least some amount of time in the wellbore after positioning. The assembly can generate less debris after being milled as compared to an assembly without recessed portions. Furthermore, the assembly can provide less resistance to milling than an assembly without recessed portions. Accordingly, a whipstock or deflector can be positioned relative to the inner diameter recess of the assembly to deflect a mill toward the inner diameter recess. The inner diameter recess can provide a channel through which the milling or drilling tool can traverse toward the portion of the assembly with the outer diameter recess. For example, the inner diameter recess can provide a lower resistance to the milling or drilling tool to mill or drill. The lower resistance can cause the milling or drilling tool to be guided toward the portion of the assembly with the outer diameter recess. The outer diameter recess can provide a channel through which the milling or drilling tool can traverse toward the subterranean formation that is adjacent to the assembly. The milling or drilling tool traversing the channel can create a window in the outer diameter recess through which a branch wellbore can be formed from a parent wellbore.

A "parent wellbore" is a wellbore from which another wellbore is drilled. It is also referred to as a "main wellbore." A parent or main wellbore does not necessarily extend directly from the earth's surface. For example, it could be a branch wellbore of another parent wellbore.

A "branch wellbore" is a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

These illustrative examples are given to introduce the reader to the general subject matter discussed here and are not intended to limit the scope of the disclosed concepts. The following sections describe various additional embodiments and examples, with reference to the drawings in which like numerals indicate like elements and directional descriptions are used to describe the illustrative embodiments but, like the illustrative embodiments, should not be used to limit the present invention.

FIG. 1 shows a well system 100 with an assembly according to one embodiment of the present invention. The well system 100 includes a parent wellbore 102 that extends through various earth strata. The parent wellbore 102 includes a casing string 106 cemented at a portion of the parent wellbore 102.

The casing string 106 includes an assembly 108 interconnected with the casing string 106. In some embodiments, the assembly 108 is a continuous portion of the casing string 106. The assembly 108 can include an inner wall recess 110 and an outer wall recess 112. The assembly 108 can be positioned at a desired location to form a branch wellbore 114 from the parent wellbore 102. The desired location can be an intersection 116 between the parent wellbore 102 and the branch wellbore 114. The assembly 108 can be positioned using various techniques. Examples of positioning techniques include using a gyroscope and using an orienting profile.

Branch wellbore 114 is depicted with dotted lines to indicate it has not yet formed. To form the branch wellbore 114, a whipstock can be positioned in the inner diameter of the casing string 106 relative to the assembly 108 and below the intersection 116. For example, keys or dogs associated with the whipstock can cooperatively engage an orienting profile to anchor the whipstock to the casing string 106 and to orient rotationally an inclined whipstock surface toward the assembly 108.

Cutting tools, such as mills and drills, are lowered through the casing string 106 and deflected toward the inner wall recess 110, which assists in guiding the cutting tool toward the outer wall recess 112. The cutting tools mill through the inner wall recess 110 and the outer wall recess 112 to form a window through which the branch wellbore 114 can be created in the subterranean formation adjacent to the window. The assembly 108 can be configured to provide a pressure seal between an inner region 118 of the casing string 106 and an environment 120 exterior to the casing string 106 prior to the window being created. Certain embodiments of the assembly 108 can generate less debris during milling as compared to an assembly with an inner wall recess 110 or an outer wall recess 112.

Assemblies according to various embodiments of the present invention can be in any desirable configuration to support branch wellbore creation. FIGS. 2A-2D depict an assembly 202 according to one embodiment of the present invention that is capable of being part of a casing string. The assembly 202 includes an inner wall 204 and an outer wall 206. An inner wall portion 208 is recessed and an outer wall portion 210 is recessed. The assembly 202 can be made from any suitable material. Examples of suitable materials include 13-chromium, 28-chromium, steel, or other stainless steel or nickel alloy.

Figure 2A:
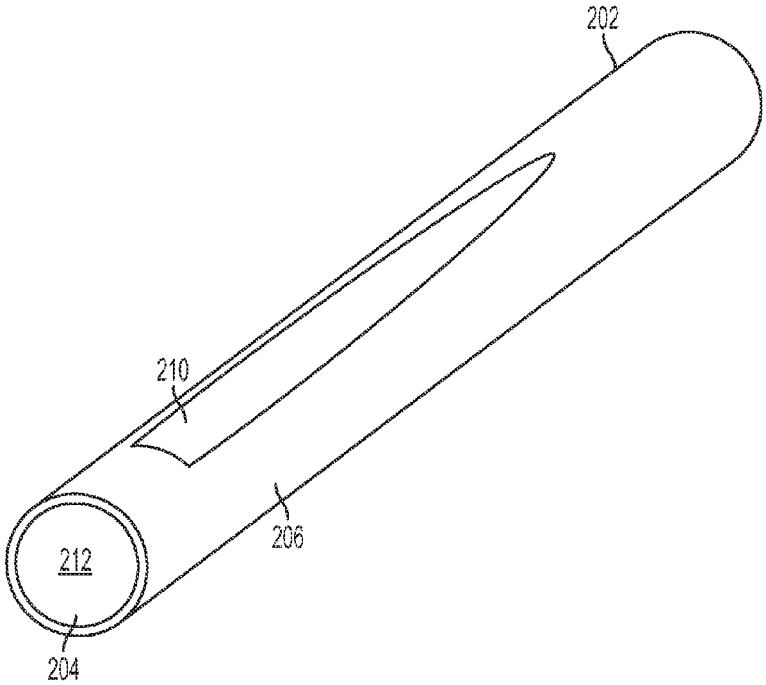
FIG. 2A is a perspective view of an outer wall of an assembly according to one embodiment of the present invention.
Figure 2B:
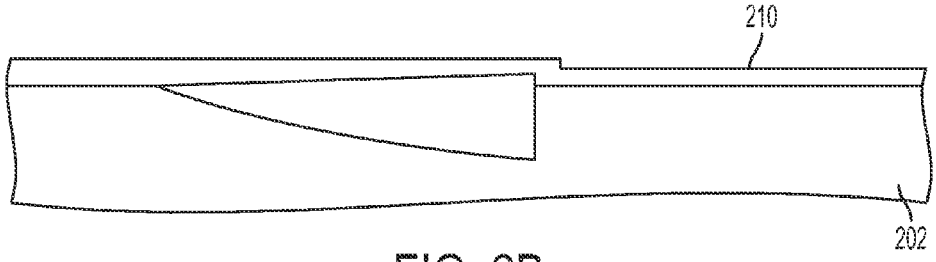
FIG. 2B is a partial cross-sectional view of the assembly of FIG. 2A according to one embodiment of the present invention.

FIG. 2A depicts the outer wall portion 210 that can be formed by removing part of the outer wall 206 such that the cross-sectional thickness of the outer wall portion 210 is less than another portion of the assembly 202. FIG. 2B depicts a partial cross-section of the outer wall portion 210 having a smaller cross-sectional thickness than other parts of the assembly 202. The outer wall portion 210 may be a groove, notch, channel, or other recess that has a smaller cross-sectional thickness than another part of the assembly 202. The inner wall portion 208 can be similarly formed and can have a cross-sectional thickness that is less than another portion of the assembly 202. The assembly 202 can be configured to provide a pressure seal in a subterranean wellbore environment between an inner region 212 defined by the assembly 202 and an environment exterior to the assembly 202, prior to a window being created.

FIG. 2A depicts the outer wall portion 210 having a tapered surface shape. For example, the outer wall portion 210 is depicted as extending along the outer wall 206 with one part of the outer wall portion 210 having a larger surface width than another part of the outer wall portion 210. The tapered surface shape can be configured to guide a milling or drilling tool. For example, the outer wall portion 210 can provide less resistance to a milling or drilling tool than other parts of the assembly 202 that have a larger cross-sectional thickness than the outer wall portion 210. As the milling or drilling tool traverses the outer wall portion 210 to form the window, the edges of the outer wall portion 210 at the narrower part of the outer wall portion can guide the milling or drilling tool to make a straighter cut than otherwise would occur.

The outer wall portion of an assembly according to various embodiments of the present invention, however, can be any surface shape, including non-tapered shapes. For example, the surface shape is substantially rectangular in some embodiments.

Figure 2C:
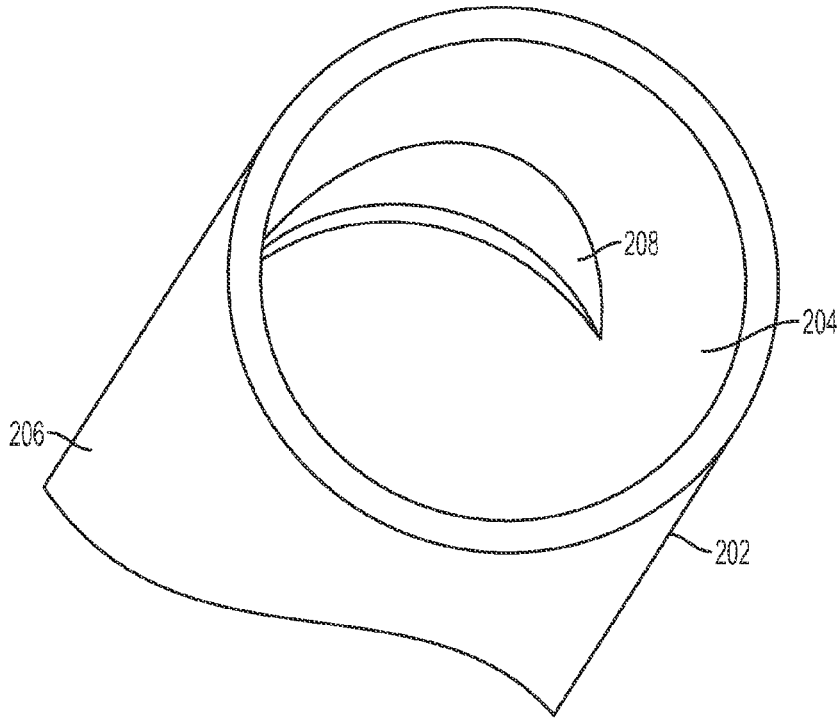
FIG. 2C is a perspective view of an inner wall of the assembly of FIG. 2A according to one embodiment of the present invention.
Figure 2D:
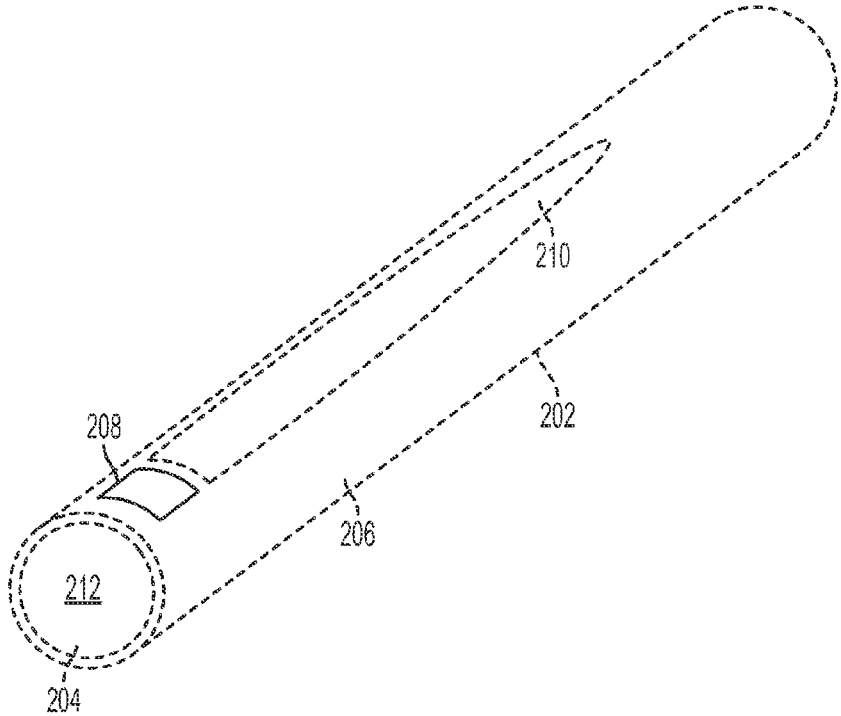
FIG. 2D is a perspective view of a position of a recess in the inner wall with respect to a recess of the outer wall of the assembly of FIG. 2A according to one embodiment of the present invention.

FIG. 2C depicts the inner wall portion 208. The inner wall portion 208 has a semi-circular surface shape, but can have any suitable surface shape. The inner wall portion 208 can provide a milling or cutting tool with a lower resistance than other portions of the assembly 202 and can provide a channel for a milling or cutting tool to traverse toward the outer wall portion 210. For example, and as depicted in FIG. 2D, the inner wall portion 208 can be located closer to the surface than the outer wall portion 210. As a cutting tool is lowered, it can be deflected toward the inner wall portion 208, which can guide the cutting tool toward the part of the assembly that is the outer wall portion 210. Although FIG. 2C depicts the inner wall portion 208 as not overlapping the outer wall portion 210, in some embodiments the assembly 202 is configured to have the inner wall portion 208 overlap the outer wall portion 210.

The thickness of each of the inner wall portion 208 and the outer wall portion 210 can be selected based on the desired pressure rating or other desirable performance characteristics. The thickness of the inner wall portion 208 may be the same as the thickness of the outer wall portion 210, or it can be different. In some embodiments, the inner wall portion 208 is smaller than the outer wall portion 210. The thickness of inner wall portion 208 may be in a range of 5% to 95% of the thickness of the assembly 202. In some embodiments, the thickness outer wall portion 210 is in a range of 5% to 95% of the thickness of the assembly 202. The thickness of the inner wall portion 208 may be more or less than the thickness of the outer wall portion 210 to, for example, achieve a desired mechanical property or millability outcome. In some embodiments, the thickness of inner wall portion 208 and outer wall portion 210 are each variable. In other embodiments, the inner wall portion 208 is the same or similar size as the outer wall portion 210.

Figure 3:
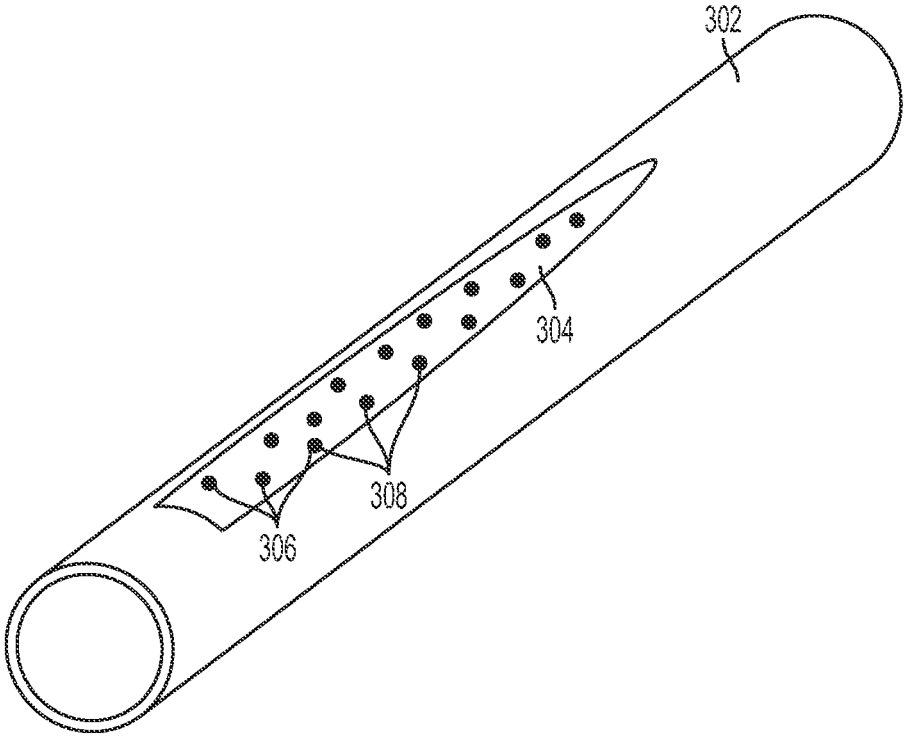
FIG. 3 is a perspective view of an outer wall of an assembly according to a second embodiment of the present invention.

Assemblies according to various embodiments can include additional components to assist in providing desired performance in maintaining integrity after the assemblies are disposed in a subterranean wellbore. For example, an assembly can include ribs or other support structures in an outer wall portion, inner wall portion, or otherwise. FIG. 3 depicts an assembly 302 according to one embodiment that includes an outer wall portion 304 with openings 306 in the outer wall portion 304. Plugs 308 are located in the openings 306. The plugs 308 can be made from a material that is capable of cooperating with the outer wall portion 304 to provide a pressure seal between an inner region and an environment exterior to the assembly prior to a window being created and that is easier to mill or drill as compared to the material from which the other parts of the assembly 302 are made. Examples of suitable materials from which plugs 308 can be made include aluminum, aluminum alloys, copper-based alloys, magnesium alloys, free-cutting steels, cast irons, carbon fiber, reinforced carbon fiber, and low carbon steel alloys, such as 1026 steel alloy and 4140 steel alloy. Assemblies according to various embodiments can include any number, from one to many, of openings and plugs.

Figure 4:
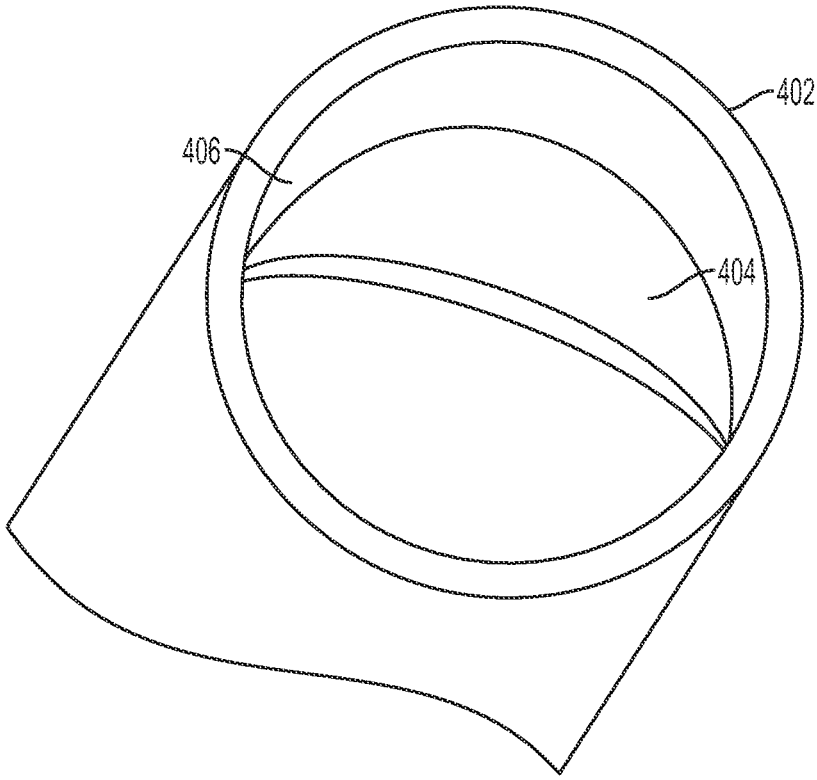
FIG. 4 is a perspective view of an inner wall of an assembly according to a second embodiment of the present invention.

Inner wall portions according to various embodiments can be of any size and of any shape. For example, FIG. 4 depicts an assembly 402 with an inner wall portion 404 in a circumferential portion of an inner wall 406. Assemblies according to some embodiments may also include an outer wall portion in an entire circumferential portion of an outer wall.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A casing string capable of being disposed in a bore, the casing string having a central longitudinal axis and comprising:

a first portion in an inner wall, the first portion having a smaller cross-sectional thickness than at least one other portion of the casing string; and a second portion in part of a circumferential portion of an outer wall of the casing string, the second portion having a smaller cross-sectional thickness than a portion of the casing string located opposite to the second portion in a cross section that is perpendicular to the central longitudinal axis of the casing string, wherein the second portion comprises a plurality of openings in which a plurality of plugs are positioned, the plurality of plugs being made from a different material than a material from which the second portion is made, wherein the casing string is capable of providing a pressure seal between an inner region defined by the casing string and an environment exterior to the casing string until at least part of the second portion is drilled or milled, and wherein the second portion is capable of providing a channel for a cutting tool to traverse toward a formation adjacent to the casing string.

2. The casing string of claim 1, wherein the first portion is recessed and the second portion is recessed.

3. The casing string of claim 1, wherein the first portion is capable of guiding the cutting tool toward the second portion.

4. The casing string of claim 1, wherein the first portion comprises a circumferential portion of the inner wall.

5. The casing string of claim 1, wherein the plurality of plugs are each made from aluminum.

6. The casing string of claim 1, wherein the second portion comprises a tapered surface shape.

7. The casing string of claim 1, where the second portion does not overlap the first portion.

8. The casing string of claim 1, wherein the second portion comprises at least one of a notch, a groove, or a recess.

9. The casing string of claim 1, wherein the first portion is capable of providing a channel for a drilling tool or for a milling tool to traverse toward the second portion.

10. The casing string of claim 1, wherein the second portion is capable of providing a channel for a drilling tool or for a milling tool to traverse toward a formation adjacent to the casing string, wherein the second portion is shaped to allow a single window to be formed through the plurality of openings.

11. The casing string of claim 1, wherein the plurality of plugs are adapted to cooperate with the second portion to provide a pressure seal between the inner region defined by the casing string and the environment exterior to the casing string prior to at least part of the second portion being drilled or milled.

12. The casing string of claim 1, wherein the second portion is positioned on one side of casing string.

13. A casing string capable of being disposed in a bore, the casing string having a central longitudinal axis and comprising:

a first section having a first cross-sectional thickness, the first section comprising a first recessed portion that is in an inner wall of the casing string, the inner wall defining an inner region;

a second section having a second cross-sectional thickness that is less than a cross-sectional thickness of a portion of the casing string opposite to the second portion in a cross section that is perpendicular to the central longitudinal axis of the casing string, the second section comprising a second recessed portion that is in an outer wall of the casing string, the second recessed portion having a plurality of openings, wherein a plurality of plugs are positioned in the plurality of openings, the plurality of plugs being made from a different material than a material from which the second section is made; and a third section having a third cross-sectional thickness that is greater than the first cross-sectional thickness and the second cross-sectional thickness, wherein the casing string is capable of providing a pressure seal between the inner region and an environment exterior to the casing string until at least part of the second recessed portion is drilled or milled.

14. The casing string of claim 13, wherein the first recessed portion is capable of providing a channel for a drilling tool or for a milling tool to traverse toward the second recessed portion, and wherein the second recessed portion is capable of guiding a cutting tool toward a formation adjacent to the casing string, wherein the second recessed portion is shaped to allow a single window to be formed through the plurality of openings.

15. The casing string of claim 13, wherein the first cross-sectional thickness is the same thickness as the second cross-sectional thickness.

16. The casing string of claim 13, wherein the second recessed portion comprises a tapered surface shape.

17. The casing string of claim 13, wherein the second recessed portion is only part of a circumferential portion of the casing string.

18. The casing string of claim 13, wherein the plurality of plugs are adapted to cooperate with the second recessed portion to provide a pressure seal between the inner region and the environment exterior to the casing string prior to at least part of the second recessed portion being drilled or milled.

19. A casing string configured for being disposed in a bore, the casing string comprising:

a first section at a first length of the casing string, the first section comprising a recessed inner wall at which a first section wall thickness is less than another first section part that is at the first length; and a second section at a second length of the casing string, the second section comprising:

a recessed outer wall at which a second section wall thickness is less than another second section part that is at the second length, the recessed outer wall being configured for providing a channel for a cutting tool to traverse toward a formation adjacent to the casing string; and a plurality of plugged openings positioned in the recessed outer wall.

20. The casing string of claim 19, wherein the another first section part is opposite to the recessed inner wall in a first cross section that is perpendicular to a first section longitudinal axis that is centered with respect to a first section outer wall, wherein the another second section part is opposite to the recessed outer wall in a second cross section that is perpendicular to a second section longitudinal axis that is centered with respect to a second section inner wall, wherein the first section and second section are configured for providing a pressure seal between an inner region defined by the casing string and an environment exterior to the casing string until at least part of the second section is drilled or milled.

* * * * *